US007752990B2

(12) United States Patent
Scourzic et al.

(10) Patent No.: US 7,752,990 B2
(45) Date of Patent: Jul. 13, 2010

(54) DEVICE FOR DESTROYING SUBSEA OR FLOATING OBJECTS

(76) Inventors: Daniel Scourzic, 16, allee des Baguiers, F-83130 La Garde (FR); Andre Meirier, Lotissement la Calade, F-83210 Sollies-Ville (FR)

( * ) Notice: Subject to any disclaimer, the term of this patent is extended or adjusted under 35 U.S.C. 154(b) by 0 days.

(21) Appl. No.: 11/664,310

(22) PCT Filed: Sep. 29, 2004

(86) PCT No.: PCT/FR2004/002466

§ 371 (c)(1),
(2), (4) Date: May 1, 2007

(87) PCT Pub. No.: WO2006/035121

PCT Pub. Date: Apr. 6, 2006

(65) Prior Publication Data

US 2008/0127876 A1 Jun. 5, 2008

(51) Int. Cl.
*B63G 8/00* (2006.01)

(52) U.S. Cl. ..... 114/312; 114/338

(58) Field of Classification Search ..... 114/312, 114/338

See application file for complete search history.

(56) References Cited

U.S. PATENT DOCUMENTS

| | | | | |
|---|---|---|---|---|
| 3,448,710 | A * | 6/1969 | Gaskins | 114/330 |
| 3,604,661 | A * | 9/1971 | Mayer, Jr. | 244/207 |
| 4,992,999 | A * | 2/1991 | Yerby et al. | 367/130 |
| 6,058,847 | A | 5/2000 | Adams | |
| 6,606,960 | B1 * | 8/2003 | Leibolt et al. | 114/315 |
| 2002/0162515 | A1 * | 11/2002 | Boyd | 119/223 |

FOREIGN PATENT DOCUMENTS

| | | |
|---|---|---|
| EP | 0612656 A1 | 8/1994 |
| FR | 2684951 | 6/1993 |
| WO | WO 01/38169 A1 | 5/2001 |

* cited by examiner

*Primary Examiner*—Stephen Avila
(74) *Attorney, Agent, or Firm*—Raymond Y. Chan; David and Raymond Patent Firm

(57) ABSTRACT

A device for destroying subsea objects comprising a first part 2 provided with propulsive units, a second part 4 which can pivot relative to the first part on an axis, so that the device can approach a subsea object from different directions, and a fairing 3 protecting the second part 4.

17 Claims, 4 Drawing Sheets

DEVICE FOR DESTROYING SUBSEA OR FLOATING OBJECTS

BACKGROUND OF THE PRESENT INVENTION

1. Field of Invention

The present invention relates to the field of devices for destroying subsea objects likely to present a hazard for navigation, for example mines.

2. Description of Related Arts

Two main types of mines are known: sea-bed mines which rest on the sea bed, and moored mines which are held by a "mooring" rope to a kentledge. Sea-bed mines are destroyed by deploying an explosive charge called "warhead" in the immediate proximity of the subsea object and exploding it. This method entails marking the mine then bringing the warhead nearby and finally causing the explosion, unlike the dragging of mines that normally is based on magneto-acoustic and/or mechanical means to trigger the mines or cut their mooring rope.

The known methods of destroying a sea-bed subsea mine comprise a step for detecting and/or identifying the mine and a step for destroying the mine using a large explosive charge, of the order of 50 to 100 kg for example, placed at a distance of a few meters from the mine to be destroyed, by means of a subsea craft, normally remote controlled. After having recovered the subsea craft on board a mine-sweeping surface vessel, the mine is destroyed by causing the charge to explode, the shockwave of which causes the mine to explode by its influence. Moored mines are destroyed using a similar method of detection and/or identification which is followed by a step which consists in hooking a squib onto the mooring rope which is placed by means of a remote-controlled or wire-guided subsea craft. Here, too, after having recovered the subsea craft, the pyrotechnic actuation of the squib is provoked by remote control from the surface vessel. The mine returns to the surface and is destroyed by an ancillary means such as a gun. Now, modern sea-bed mines may no longer explode by influence and the destruction by gun of floating moored mines that have been cut or mines drifting on the surface can be difficult because of choppy sea and/or poor visibility. It is therefore necessary to position the warhead very accurately relative to the mine to ensure its destruction. This is also true for the moored mines that are to be destroyed directly, which is relatively difficult, particularly where there are underwater currents. Furthermore, recovering the subsea craft takes time.

Various types of remote-controlled or wire-guided subsea craft are known, in particular from the patents published by ECA, particularly FR-2 684 951 and EP-0 612 656.

Among these craft, there are also consumable craft.

Conventional single-body craft do not allow for objects to be observed and then attacked from above, from below or from the side, unless they have a propulsive architecture that enables the craft to be directed. This leads to the presence of a large number of propulsive units, which considerably increases the cost of the craft. Even provided with numerous propulsive units, the craft cannot work at large angles of inclination, of the order of 50 to 60°, or above. This is all the more true in the presence of sea currents, where such a craft will have great difficulty in maintaining its stability and holding its position.

Document WO 01/38169 (ECA) discloses a mine neutralizing submersible craft, comprising a first part provided with a propulsive unit and a second part that pivots relative to the first and comprising a warhead and at least one sensor for detecting the subsea object so that the warhead and the sensor are oriented similarly relative to a subsea object. The warhead is positioned correctly relative to the subsea object once it is located, hence a better effectiveness.

However, the applicant has realized that the pivoting of the second part would risk modifying the hydrodynamic characteristics of the craft and, as a consequence, provoke an undesirable movement of the submersible craft relative to the subsea object.

SUMMARY OF THE PRESENT INVENTION

The invention aims to overcome these drawbacks.

The invention proposes a craft for destroying subsea objects that is fairly insensitive to the pivoting of the second part.

The invention proposes a consumable craft for destroying subsea objects, which can destroy more certainly and more reliably.

The device, according to one aspect of the invention, is intended for the destruction of floating subsea objects. The device comprises a first part provided with propulsion means and a second part that can pivot relative to the first part along on least one axis, so that the device can approach a subsea object from different directions. The device comprises at least one fairing protecting the second part. The fairing is permeable to water.

According to another embodiment, the fairing can be a shell resistant to hydrostatic pressure, joined to the first part or the second part.

Thus, the second part surrounded by the fairing can pivot, with the hydrodynamics of the device being maintained. The mobility characteristics of the craft are maintained, hence it is easier to control, quicker to bring into a firing position, more reliable in operation, and has a higher destruction success rate. Any projecting sensors on the second part disposed inside the fairing can pivot, provoking only a marginal or even zero modification to its water resistance.

Advantageously, the device comprises means of pivoting the second part relative to the first part, the pivoting means being provided with at least one motor.

In one embodiment of the invention, the pivoting axis is transversal.

In one embodiment of the invention, the pivoting axis is longitudinal.

In one embodiment of the invention, the pivoting axis is vertical.

A combination of two pivoting axes is possible.

Advantageously, the fairing is substantially acoustically transparent.

Advantageously, the fairing is substantially optically transparent. The fairing can be made of plexiglas® for example.

In one embodiment of the invention, the fairing is fixed to the first part to improve the hydrodynamics in all phases of navigation and protect the second part from any debris likely to be encountered. The fairing can be fixed to the front of the first part. The fairing can be fixed roughly to the center of the first part. The fairing can take the form of a portion of a sphere or cylinder, or a combination of both connected to a cylindrical body of the first part.

In another embodiment of the invention, the fairing is fixed to the second part.

In one embodiment of the invention, the fairing has a hydrodynamically isotropic shape.

In one embodiment of the invention, the fairing has a symmetry of revolution relative to the pivoting axis.

In one embodiment of the invention, the second part comprises at least one means of observing subsea objects, for example a camera.

In one embodiment of the invention, the second part comprises at least one means of identifying subsea objects.

In one embodiment of the invention, the second part comprises at least one means of locating a subsea object, for example a sonar.

In one embodiment of the invention, the second part comprises at least one means of estimating the distance from said subsea object.

In one embodiment of the invention, the second part comprises at least one means of classifying subsea objects.

In one embodiment of the invention, the second part comprises at least one attack means.

The craft can be deployed from a surface vessel, but also from an aircraft. In the latter case, a relay on the surface of the water can be used to transform the acoustic signals emitted by the subsea craft into radio or optical or electrical signals, for sending to the aircraft. The warhead will generally be a shaped charge, the exploding of which mainly acts along an axis, hence the importance of the positioning relative to the subsea object to be destroyed, and this all the more so as each type of mine has areas more sensitive or fragile than others to an external explosion.

The pivoting of the swiveling part with a destruction charge and at least one sensor does not substantially alter the hydrodynamic characteristics of the craft, the piloting of which, whether manual, remote controlled or automatic, is made easier.

The present invention will be better understood from studying the detailed description of one particular embodiment taken by way of example, by no means limiting, and illustrated by the appended drawings

DETAILED DESCRIPTION OF THE PREFERRED EMBODIMENT

Figure 3:
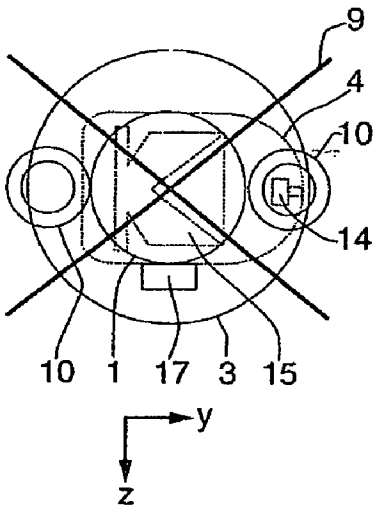
FIG. 3 is a diagrammatic front view of the subsea craft of FIG. 1.
Figure 1:
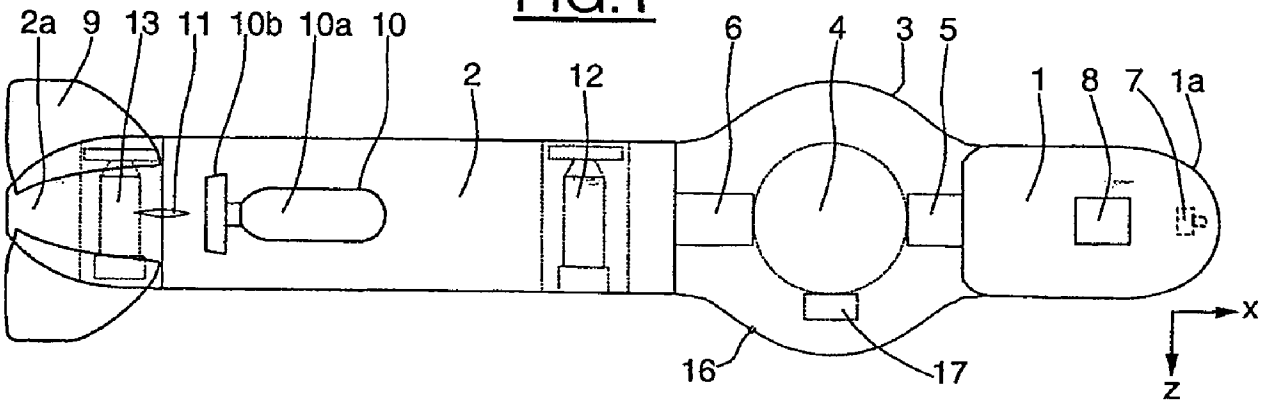
FIG. 1 is a side view in elevation of a subsea craft according to one embodiment of the invention.
Figure 2:
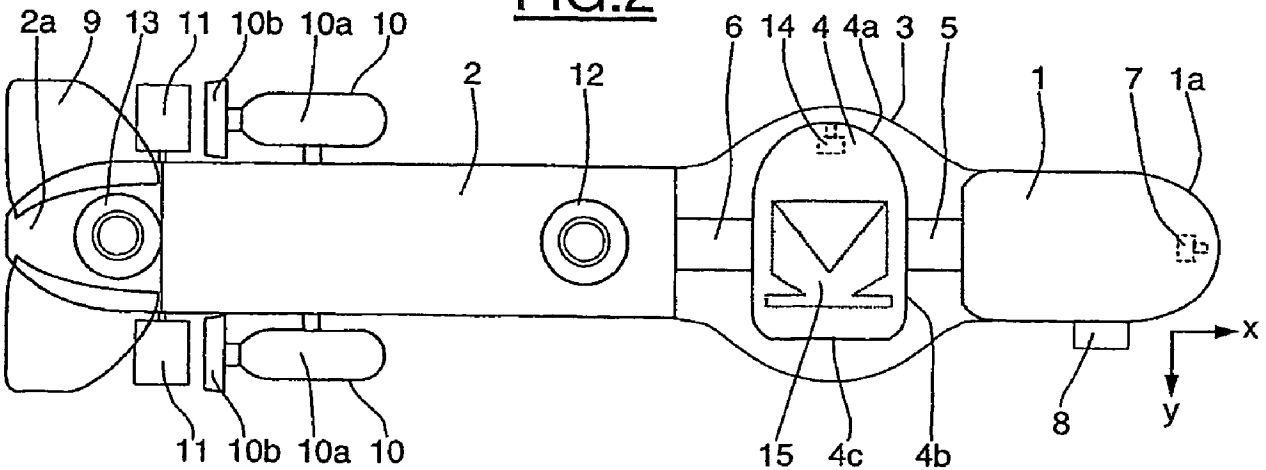
FIG. 2 is a top view in elevation of the subsea craft of FIG. 1.

As can be seen in FIGS. 1 to 3, the subsea craft comprises a front body 1, of generally cylindrical shape, and having a front end 1*a* of generally hemispherical shape, a rear body 2, of generally cylindrical shape, and provided with a rear end 2*a* of truncated ogival shape, a fairing 3 disposed between the front body 1 and rear body 2, of generally spherical shape, truncated by two parallel planes equidistant from the center of said sphere and connected to the front body 1 and rear body 2 by connecting fillets of generally torroidal shape, and a pivoting part 4 disposed in the fairing 3 about a longitudinal axis X of the subsea craft, the lateral axis being denoted Y and the depths axis or vertical axis being denoted Z, according to the normal position of a craft in the water.

The pivoting part 4 is supported by the front body 1 and rear body 2 by trunions, respectively 5 and 6. One of the two trunions 5 or 6 is motorized, so that the rotation of the pivoting part 4 is controlled. The pivoting part 4 can pivot by plus or minus 180° about the X axis.

The front body 1 comprises a camera 7 disposed at the hemispherical end 1*a* made of transparent material to allow the subsea craft to be controlled automatically or by remote control. The front body 1 is also provided with a sonar 8 disposed to one side of the cylindrical portion of said front body 1.

The rear body 2 is provided with a tail unit 9 fixed to its truncated ogival end 2*a*, in the shape of a cross and maintaining the stability of the movement of the subsea craft in the water. The tail unit 9 is fixed relative to the rear body 2. The longitudinal propulsion of the subsea craft is provided by two longitudinal propulsive units 10 fixed to either side of the rear body 2 in front of the tail unit 9. The propulsive units 10 are fixed relative to the rear body 2 and each comprises a body 10*a* of cylindrical shape, rounded at the ends, provided with an electric motor and a streamlined propeller 10*b* driven by the electric motor of the body 10*a* and disposed between said body 10*a* and the tail unit 9. The propulsive units 10 provide the movement along the X axis and the orientation of the subsea craft in a plane (X, Y), and are symmetrical relative to a plane (X, Z).

The rear body 2 supports two inclinable panels 11, disposed a short distance behind the propulsive units 10, to be located in the stream of water driven by said propulsive units 10. The inclinable panels 11 are also symmetrical relative to the plane (X, Z) and enable the subsea craft to be directed towards the surface or, on the contrary, towards the seabed. The inclinable panels 11 form depth control surfaces and pivot about an axis parallel to the Y axis, by means of actuators, not shown, disposed in the rear body 2.

Two vertical propulsive units 12 and 13 are also provided, disposed in the rear body 2, one close to the fairing 3, the other roughly on a level with the rear tail unit 9. The vertical propulsive units 12 and 13 enable the subsea craft to be moved along the Z axis, even in the absence of movement along the X axis. The vertical propulsive units 12 and 13 are well suited to ensure the fine positioning of the subsea craft in proximity to an object needing to be identified and/or destroyed.

The pivoting part 4, disposed in the fairing 3, has a shape of revolution with a roughly hemispherical head 4*a*, see FIG. 2, a roughly cylindrical central part 4*b*, and a flat rear part 4*c* linked to the central part 4*b* by connecting fillets. With the trunions 5 and 6, the pivoting part 4 can be moved rotationwise about the X axis. A camera 14 is disposed in the front part 4*a* and an explosive charge 15, of the shaped charge type, is disposed in the central part 4*b* and designed to deliver the energy of the explosion towards the front part 4*a* of the pivoting part 4. The camera 14 and the explosive charge 15 are oriented roughly coaxially towards the front of the pivoting part 4.

In other words, the observation by the camera 14 and the destruction of a suspect object can be performed in a plane transversal to the longitudinal axis X of the subsea craft. Orienting the pivoting part 4 in a transverse plane makes it possible to approach a suspect object from above, by orienting the pivoting part 4 downward, from below, by orienting the pivoting part 4 upward as illustrated in FIG. 2, which can prove interesting in the case of moored mines, or even from the side by orienting the pivoting part 4 to one side or the other of the subsea craft. Naturally, all intermediate oblique orientations are possible.

The fairing 3 is made of an optically transparent material, so that the camera can observe an object which is located in the vicinity of the subsea craft. The diameter of the fairing 3 can be greater than that of the rear body 2. The fairing 3 can be made of a transparent synthetic material, such as plexiglas, and is drilled with one or more holes 16 to enable it to be filled with water when the subsea craft is deployed in the water. It is thus possible to use a fairing 3 that is fairly thin, fairly unresistant to the pressure exerted by the water, and consequently of low weight, inexpensive and hampering neither the optical observation nor the effects of the explosion on the suspect object.

Optionally, and as shown in FIG. 1, the subsea craft is also provided with an acoustic sensor 17, for example a sonar, supported by the central portion 4*b* of the pivoting part 4. Thus, the detection and locating of the suspect object is encouraged, as is the fine positioning of the subsea craft relative to the subsea object, particularly in turbid waters, for example charged with sediments. The acoustic waves are transmitted by the water which is inside the fairing 3, and by the fairing 3 made of acoustically transparent material.

Figure 6:
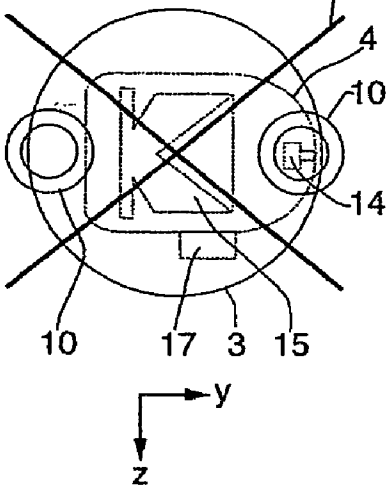
FIG. 6 is a front diagrammatic view of the subsea craft of FIG. 4.
Figure 4:
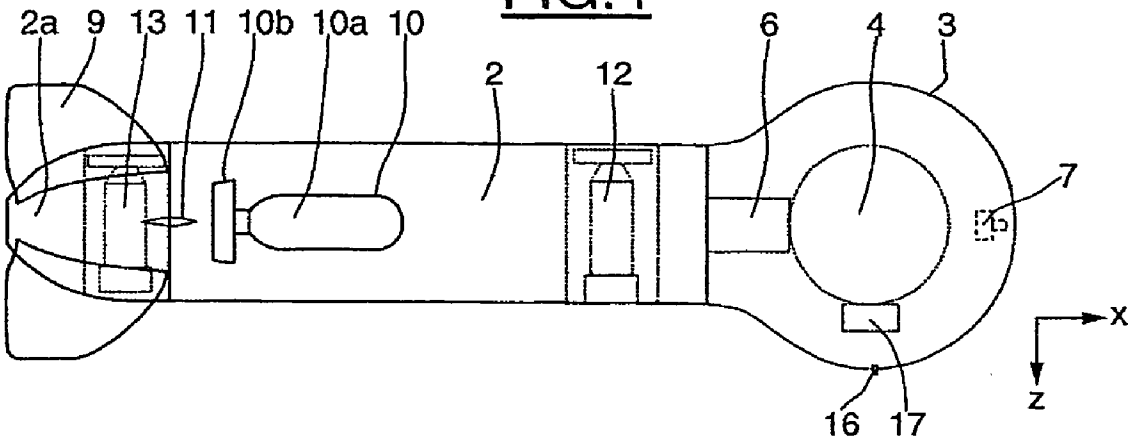
FIG. 4 is a side view in elevation of a subsea craft according to another embodiment of the invention.
Figure 5:
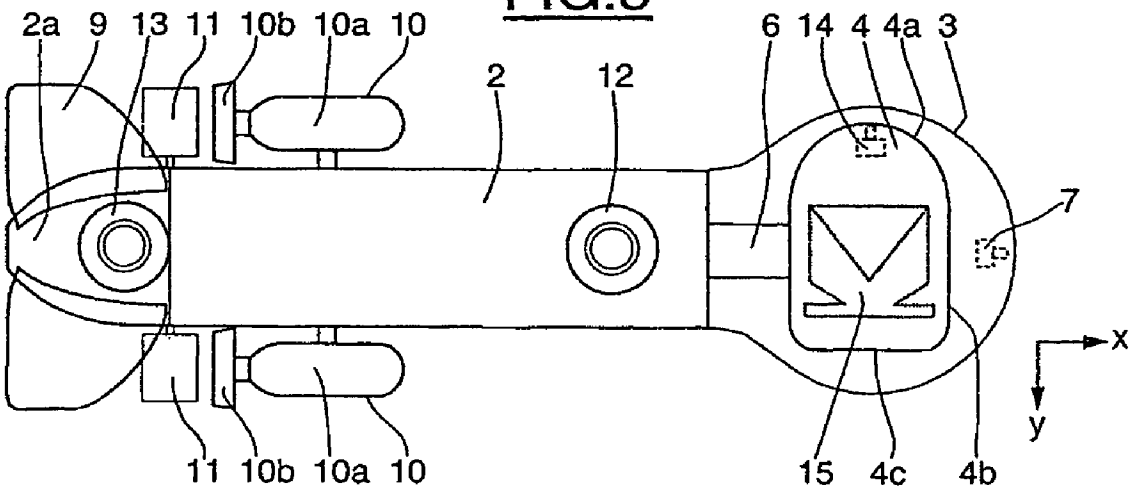
FIG. 5 is a top view in elevation of the subsea craft of FIG. 4.

The embodiment illustrated in FIGS. 4 to 6 is distinguished from the preceding one in that the subsea craft is not provided with a front body and the associated sonar. The fairing 3 forms the front end of the subsea craft and takes the form of a sphere truncated at the back by a plane transversal to the longitudinal axis X and joined to the rear body 2 by a connecting fillet of generally torroidal shape. The pivoting part 4 is mounted to pivot on the single trunion 6 joined to the rear body 2. The camera 14 and the acoustic sensor 17 enable the subsea craft to locate and recognize a suspect object. The camera 7 is fixed to the front of the fairing 3 and is oriented towards the front to provide vision in the direction of navigation.

Figure 9:
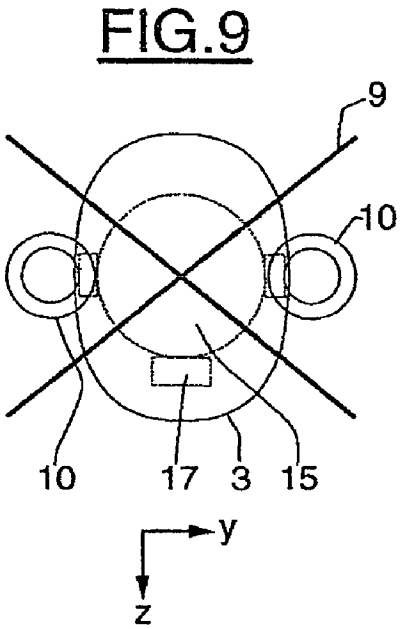
FIG. 9 is a front diagrammatic view of the subsea craft of FIG. 7.
Figure 7:
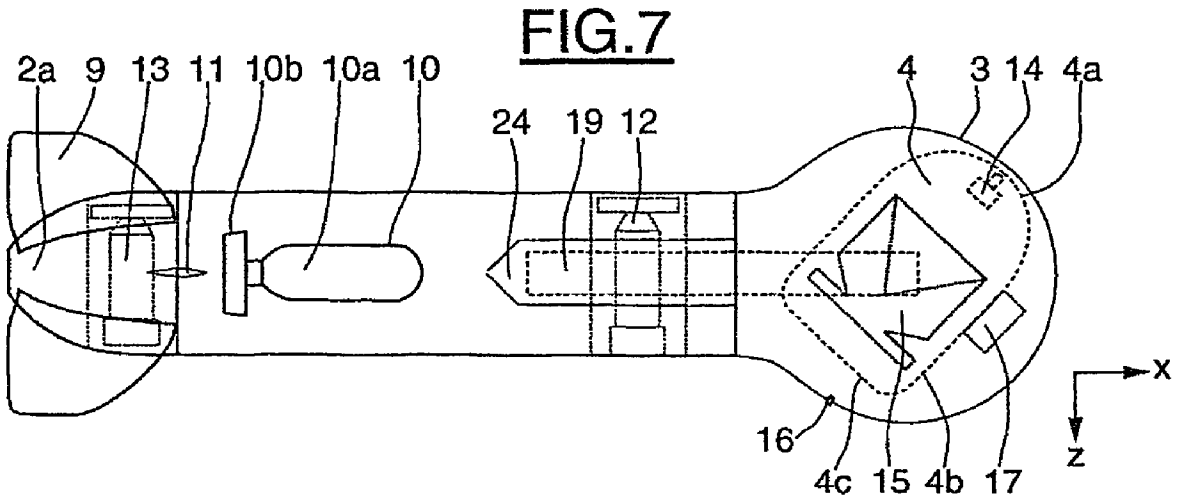
FIG. 7 is a side view in elevation of a subsea craft according to another embodiment of the invention.
Figure 8:
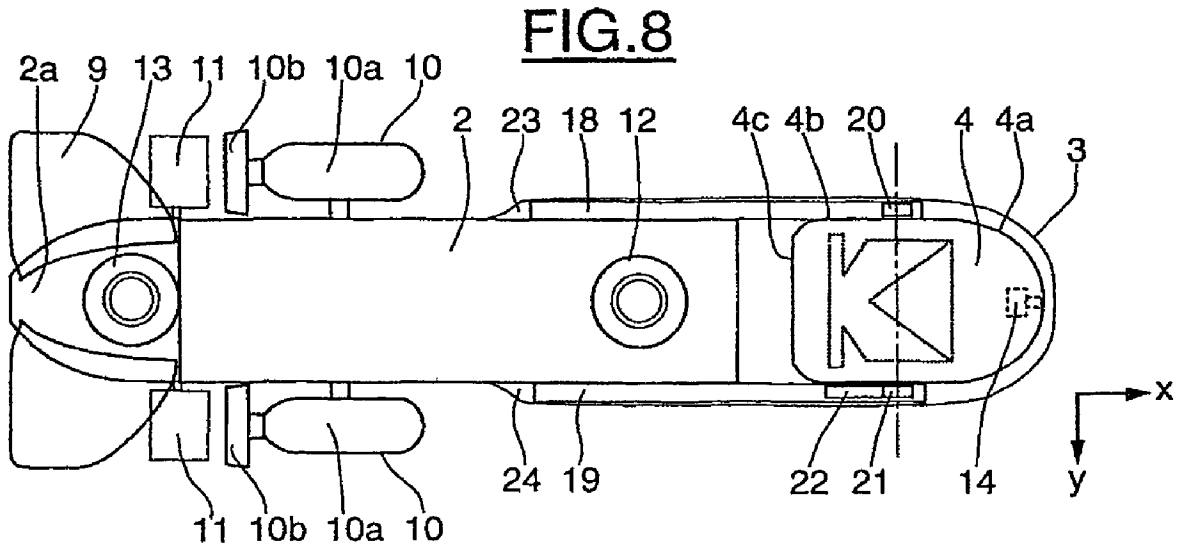
FIG. 8 is a top view in elevation of the subsea craft of FIG. 7.

The embodiment illustrated in FIGS. 7 to 9 relates to the preceding one by the presence of the fairing 3, forming the front end of the subsea craft. The subsea craft comprises two arms 18 and 19 parallel to the longitudinal axis X, fixed to the rear body 2 and extending partly along the rear body 2 and partly beyond said rear body 2 towards the front. The arms 18 and 19 are symmetrical relative to the plane (X, Z) and each supports at its free end a trunion 20, 21 on which is hinged the pivoting part 4. The trunions 20, 21 are aligned on an axis parallel to the transverse axis Y. An actuator 22 housed in the aim 19 makes it possible to control the pivot position of the pivoting part 4. The part 4 can be made to pivot over an angle of at least plus or minus 90°. The camera 14 can provide the vision in the direction of navigation in the absence of a fixed camera.

As can be seen more particularly in FIG. 9, the fairing 3 has, seen from the front, a generally ellipsoidal shape having a height on the Z axis greater than its width on the Y axis and thus enabling the pivoting part 4 to have enough space inside said fairing 3. The part of the arms 18 and 19 fixed to the rear body 2 can also be covered by a portion of fairing 23, 24, of streamlined shape, ensuring a lesser resistance to progress in the water. The part of the arms 18 and 19 projecting relative to the rear body 2 is disposed inside the fairing 3.

In an approach phase, the pivoting part 4 can be directed towards the front of the craft, so as to be able to detect any obstacles. In a suspect object search phase, the pivoting part 4 can sweep the possible pivoting range to increase the probability of detecting a suspect object. In a destruction phase, the pivoting part 4 is then inclined to the required angle, ensuring the best probability of destruction according to the shape and characteristics of the suspect object.

Figure 12:
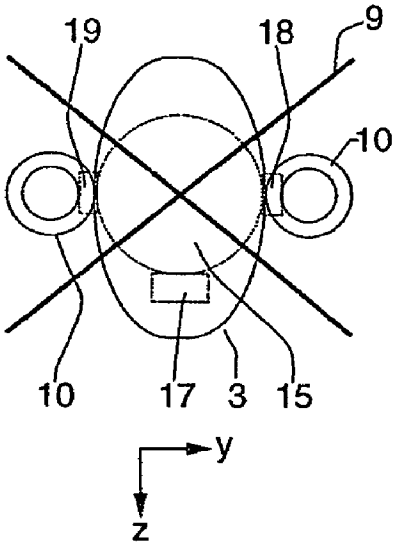
FIG. 12 is a front diagrammatic view of the subsea craft of FIG. 7.
Figure 10:
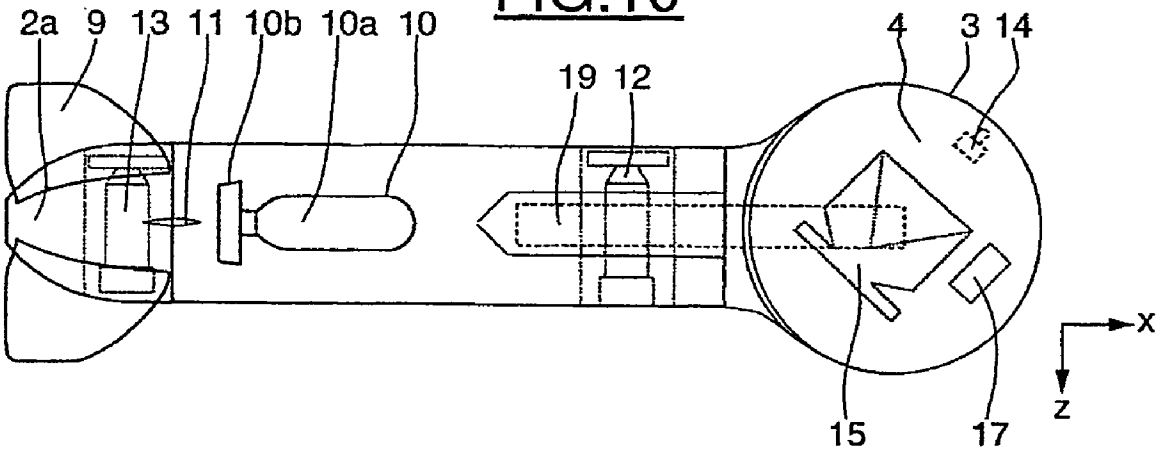
FIG. 10 is a side view in elevation of a subsea craft according to another embodiment of the invention.
Figure 11:
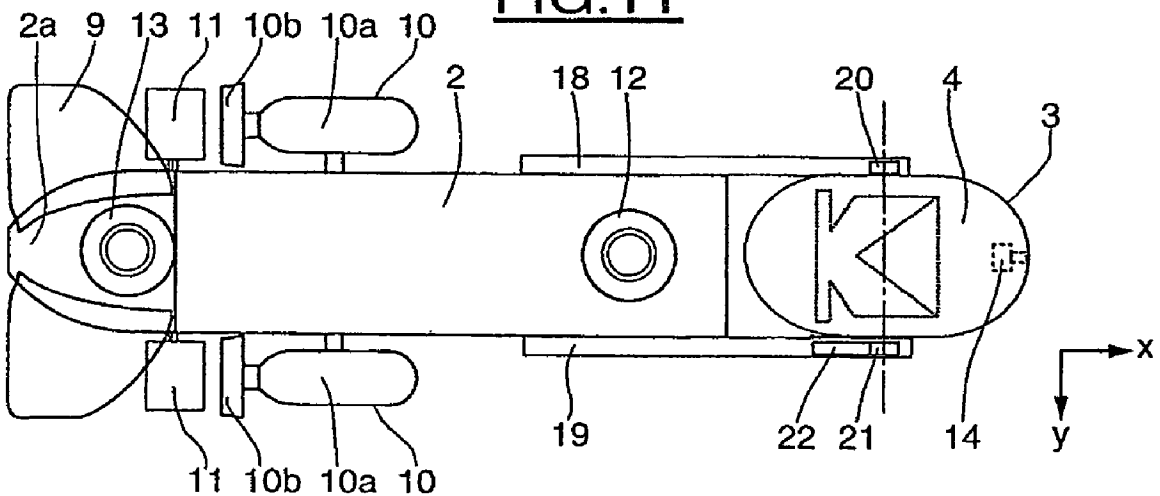
FIG. 11 is a top view in elevation of the subsea craft of FIG. 7.

The embodiment illustrated in FIGS. 10 to 12 is distinguished from the preceding one by the fact that the fairing 3 is solidly fixed to the pivoting part 4 and that the fixed part 2 has a connection with the fairing 3 by means of the arms 18 and 19 disposed laterally either side of the fairing 3. The fairing 3 has a section that is circular in cross section on a plane parallel to the plane (X, Z) and pivots about the Y axis. The hydrodynamics are maintained on rotation. In cross section on a plane passing through the pivoting axis, the fairing 3 is of roughly ellipsoidal shape. The fairing 3 is resistant to pressure and therefore not provided with holes.

In the abovementioned three embodiments, the pivoting part provided with at least one sensor, for example optical or acoustic, is disposed inside a fairing so that the pivoting of said pivoting part does not alter the flow of water along its outer walls. In other words, the hydrodynamics of the subsea craft are independent of the orientation of the pivoting part 4. An accurate and easier positioning is thus assured, preventing the modification of the inclination of a projecting unit, for example the acoustic sensor 17, from altering the flow of water along the subsea craft and requiring the position of the subsea craft to be restored by an action on the vertical propulsive units 12 and 13, on the longitudinal propulsive units 10, on the inclinable panels 11, or even on the pivoting part 4 itself. This advantage is all the more significant where there are strong sea currents, which is reflected in a relatively high speed of the subsea craft relative to the water and a zero or almost zero relative speed of the subsea craft relative to the suspect object. In such a case, modifying the hydrodynamics risks provoking either an unwanted distancing of the subsea craft from the suspect object, or a direct impact, risking damaging the subsea craft without setting the explosive charge in ideal operating conditions, a shaped charge possibly requiring a certain distance from the suspect object to be destroyed to obtain maximum destructive effect.

The piloting of the subsea craft is thus made simpler and the destruction of the suspect object can be conducted more rapidly, which is reflected in a not-inconsiderable saving on operating cost, in as much as the ship or aircraft having deployed the subsea craft to destroy the suspect object normally remains close to the area where the suspect object is located until it is destroyed.

What is claimed is:

1. A device for destroying subsea or floating objects comprising:

a rear body provided with propulsion means;

a pivoting part comprising:

means of observing subsea objects, an explosive charge, and means for rotating the pivoting part relative to the rear body along at least one axis so that the device can approach a subsea object from different directions; and a fairing, wherein means for rotating the pivoting part, means for observing subsea objects and the explosive charge are included within the fairing in order to maintain constant the hydrodynamics of the device and independent of the orientation of the pivoting part relative to the rear body so as to not alter the flow of water along the device.

2. The device, as recited in claim 1, wherein said fairing is permeable to water.

3. The device, as recited in claim 2, wherein said fairing forms a shell resistant to hydrostatic pressure.

4. The device as recited in claim 1, wherein said pivoting means comprises at least one motor.

5. The device, as recited in claim 1, wherein said pivoting axis is transversal.

6. The device as recited in claim 1, wherein said pivoting axis is longitudinal.

7. The device, as recited in claim 1, wherein said pivoting axis is vertical.

8. The device as claimed in claim 1, wherein said pivoting takes place about two axes.

9. The device, as recited in claim 1, wherein said fairing is substantially acoustically transparent.

10. The device, as recited in claim 1, wherein said fairing is substantially optically transparent.

11. The device, as recited in claim 1, wherein said fairing is fixed to said rear body.

12. The device, as recited in claim 1, wherein said fairing is fixed to a front side of said rear body.

13. The device, as recited in claim 1, wherein said fairing is fixed roughly to a center portion of said rear body.

14. The device, as recited in claim 1, wherein said fairing is fixed to said pivoting part.

15. The device, as recited in claim 14, wherein said fairing has a hydro-dynamically isotropic shape.

16. The device, as recited in claim 1, wherein said fairing has a symmetry of revolution relative to the pivoting axis.

17. The device, as recited in claim 1, further comprising means for identifying subsea objects, means for locating a subsea object, means for estimating the distance from said subsea object, and means for classifying subsea objects, and one attacking means.

* * * * *